US009491995B1

(12) United States Patent
Sichi

(10) Patent No.: US 9,491,995 B1
(45) Date of Patent: Nov. 15, 2016

(54) JEWELRY HOLDER

(71) Applicant: Margaret Sichi, Petaluma, CA (US)

(72) Inventor: Margaret Sichi, Petaluma, CA (US)

( * ) Notice: Subject to any disclaimer, the term of this patent is extended or adjusted under 35 U.S.C. 154(b) by 406 days.

(21) Appl. No.: 14/062,889

(22) Filed: Oct. 25, 2013

Related U.S. Application Data

(60) Provisional application No. 61/718,644, filed on Oct. 25, 2012.

(51) Int. Cl.
*A45C 11/00* (2006.01)
*A45C 11/16* (2006.01)
*B65B 5/04* (2006.01)

(52) U.S. Cl.
CPC ..... *A45C 11/00* (2013.01); *A45C 11/16* (2013.01); *B65B 5/045* (2013.01)

(58) Field of Classification Search
CPC ..... A45C 11/16; A45C 11/00; G07D 9/002; B65D 75/30; B65D 31/02; B65B 5/045
USPC ..... 206/6.1, 484, 484.2, 0.8; 53/468
See application file for complete search history.

(56) References Cited

U.S. PATENT DOCUMENTS 3,756,399 A * 9/1973 Cosier ..... B65D 75/305 174/547
4,735,246 A * 4/1988 Niehaus ..... A45C 7/0095 206/479
4,760,920 A * 8/1988 Thomsen ..... A45C 11/16 150/131
4,848,562 A * 7/1989 Liu ..... A45C 13/02 150/108
4,930,635 A * 6/1990 Hotchkiss ..... A45C 11/16 150/131
5,460,269 A * 10/1995 Bayer ..... B65D 75/305 206/484.1
5,617,948 A * 4/1997 Rainey ..... A45C 11/16 206/5
5,860,855 A * 1/1999 Alberti ..... G07D 9/002 150/112
7,731,023 B1 * 6/2010 Lesch ..... A47G 1/12 190/101
2007/0246389 A1 * 10/2007 Marcello ..... A45C 11/00 206/472

* cited by examiner

*Primary Examiner* — Steven A. Reynolds
(74) *Attorney, Agent, or Firm* — Edward S. Sherman

(57) ABSTRACT

A jewelry storage, display or travel case has an upper planar layer of a pliable plastic sheet and clings to a lower plastic sheet for insertion of delicate jewelry there between. The lower plastic sheet is stiffened by a backing layer so that the upper pliable layer can be peeled away without disturbing the support provided to delicate jewelry stored within. The laminate of the 2 plastic sheets and the backing layer is optionally flexible enough to roll for packing, or can be stiffer for forming rigid pages in a binder or packing in a strong stack. The case can have transparent plastic pliable sheets on opposite side of the backing layer, each being capable being peeled away from a lower plastic sheet laminated to opposing sides of the backing layer.

26 Claims, 14 Drawing Sheets

FIG. 1A
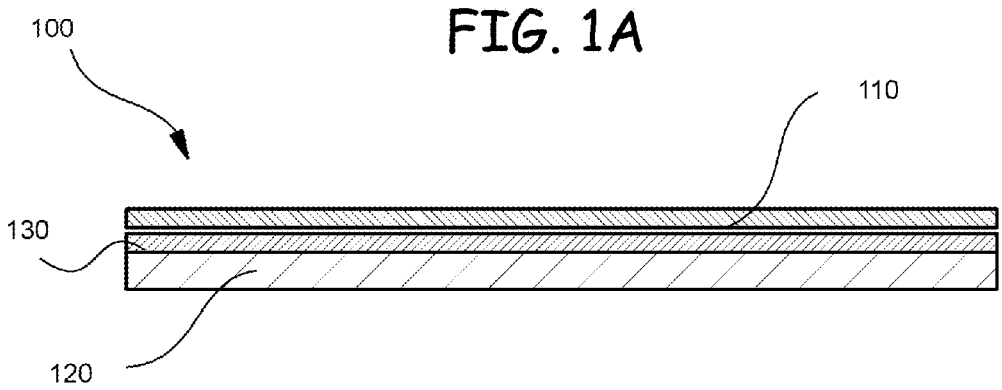
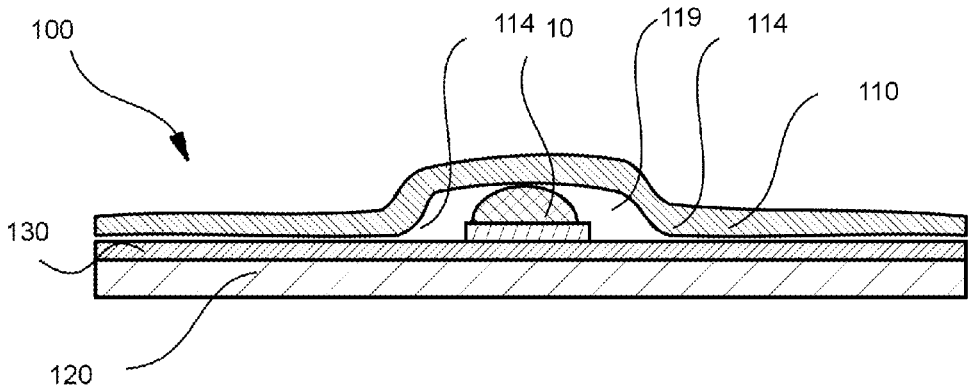
FIG. 1B
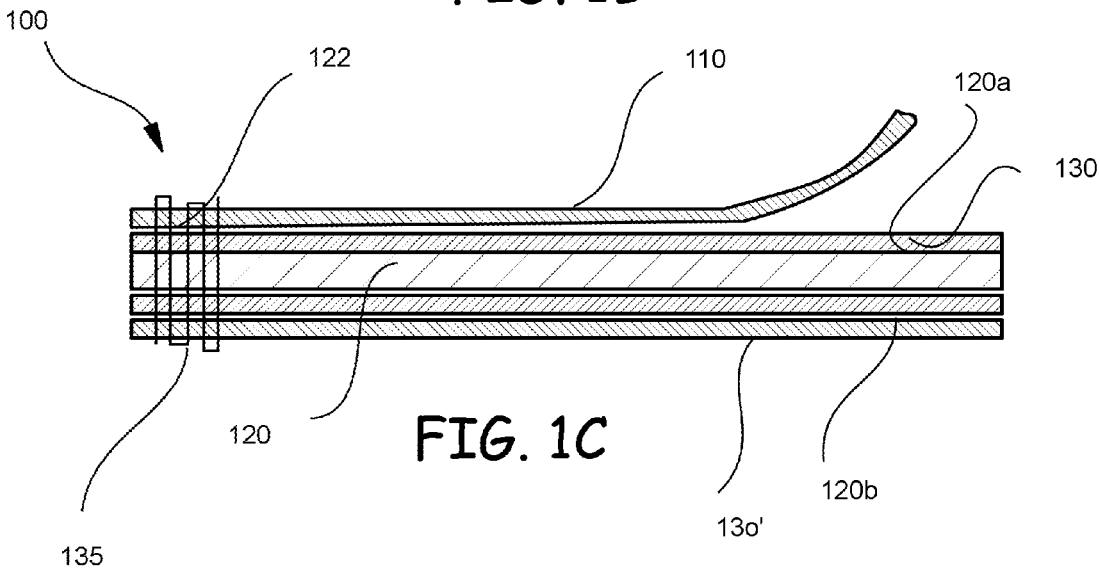
FIG. 1C

FIG. 5A
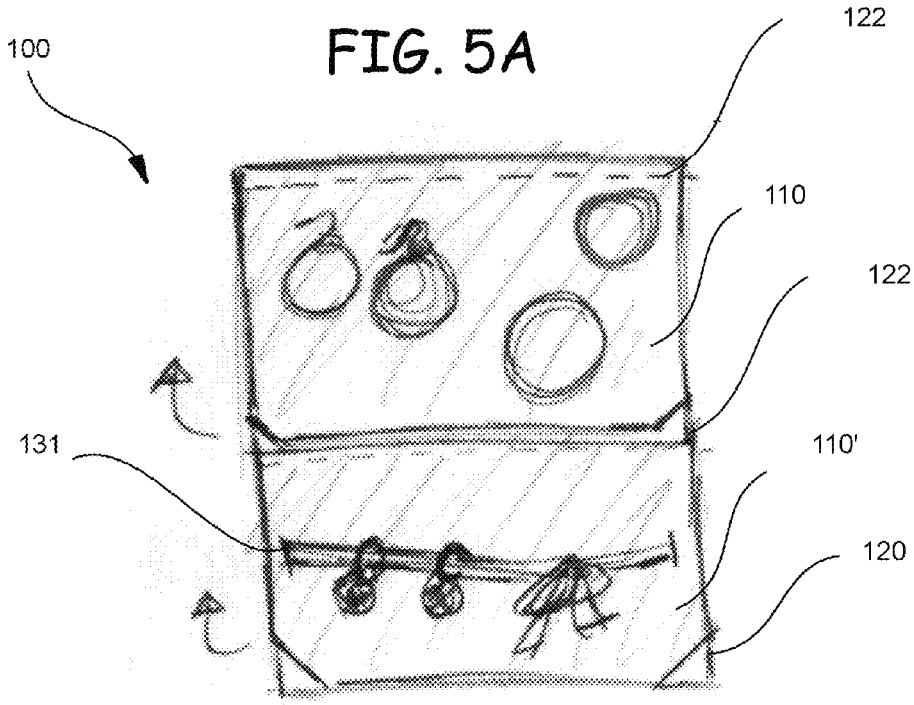
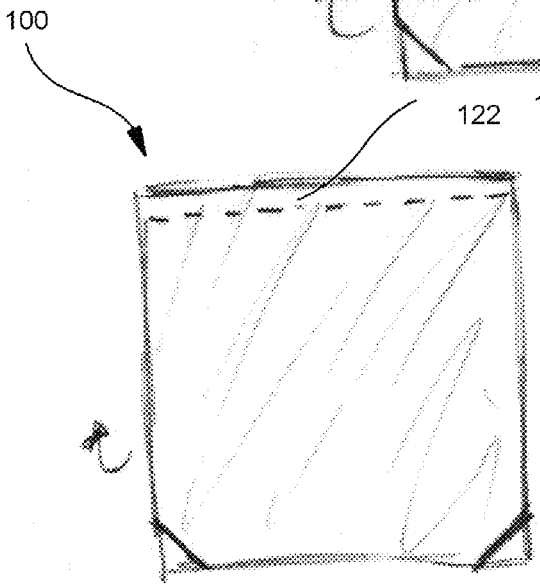
FIG. 5B
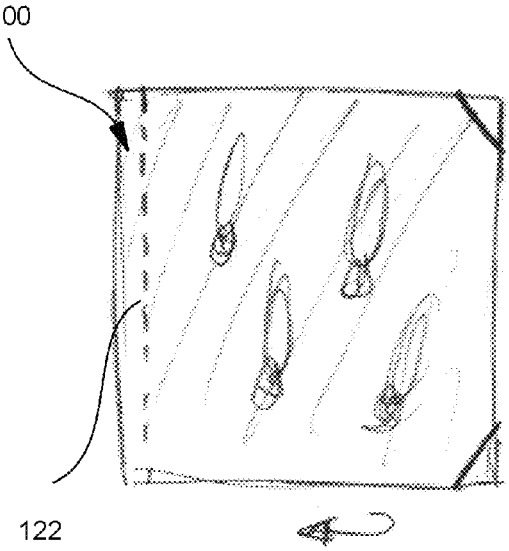
FIG. 5C

100

FIG. 13A
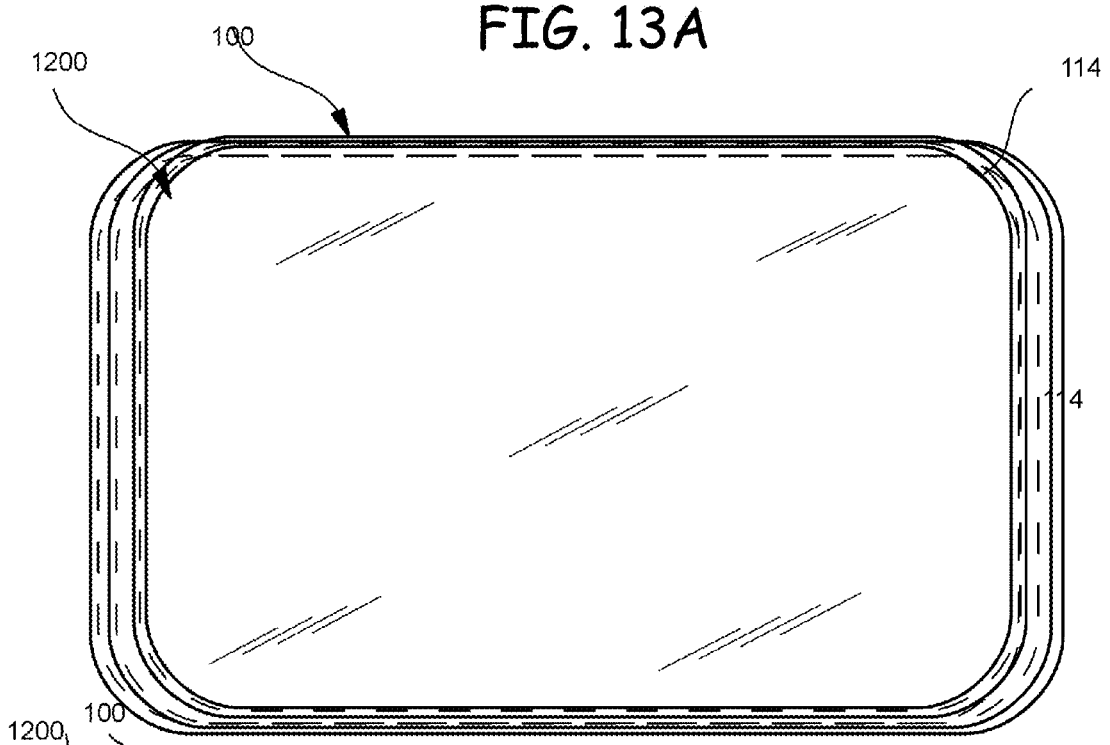
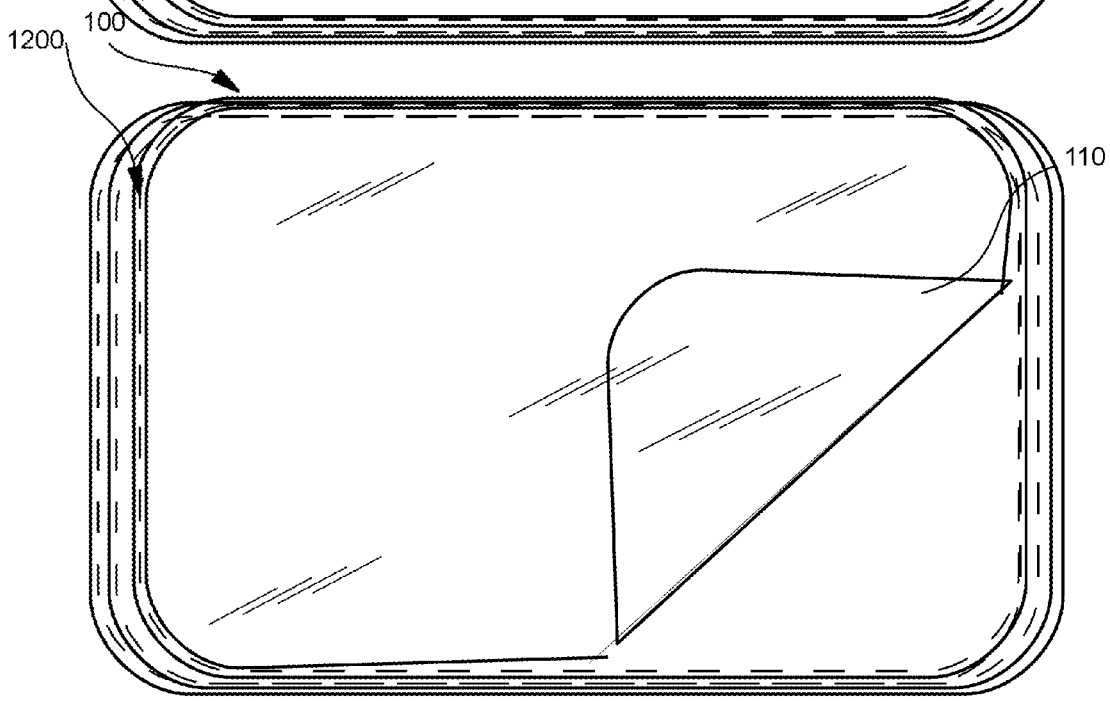
FIG. 13B

JEWELRY HOLDER

CROSS REFERENCE TO RELATED APPLICATIONS

The present application claims the benefit of priority to the U.S. Provisional Patent application of the same title that was filed on Oct. 25, 2012, having application Ser. No. 61/718,644, and is incorporated herein by reference.

The application as filed contains one or more claims having an effective filing date after Mar. 16, 2013.

BACKGROUND OF INVENTION

The present invention relates to an apparatus for storing, displaying, merchandizing and transporting jewelry during personal travel.

Prior methods of jewelry travel rolls and cases allow delicate jewelry to tangle and break. Jewelry has been stored for travel in rolls to provide protection, but such rolls can be hard to pack or fit in hand luggage. Further, it can also be difficult to find jewelry in a roll pack, especially if it has moved or become tangled.

It is therefore a first object of the present invention to provide an improved means for increased viewability of the contents.

It is therefore another object of the present invention to provide a greater ease of packing.

It is a still further object of the invention to provide the above benefits while still the preventing the tangling of fine jewelry chains, or the intermeshing of various jewelry items, which if not removed very carefully can result in damage.

It is a still further object of the invention to provide tarnish prevention of jewelry during storage and travel.

SUMMARY OF INVENTION

In the present invention, the first object is achieved by providing a jewelry holder, comprising at least a first pliable plastic cover sheet, a backing layer having a top and bottom opposing sides, the backing layer being less pliable than the plastic cover sheet, an upper plastic layer attached to the top side of the backing layer and directly opposing the first pliable plastic cover sheet for the detachable clinging engagement therewith, wherein the first pliable plastic cover sheet, backing layer and upper plastic layer are detachably laminated together with the cover layer having two or edges sides capable of folding away from the upper plastic layer for inserting and removing materials to be held there between.

Other objects of the invention are achieved by a second aspect of the invention that is characterized by the jewelry holder further comprising a lower plastic layer attached to the bottom side of the backing layer, a second pliable plastic sheet attached to at least one of the backing layer and the lower plastic layer and directly opposing the lower plastic layer for the detachable clinging engagement therewith, and having two or more sides capable of folding away from the lower plastic layer for the insertion and removable of materials to be held there between.

Still further objects of the invention are achieved by the jewelry holder having a first pliable plastic cover sheet that is a transparent vinyl sheet and an upper plastic layer is a vinyl sheet.

Still further objects of the invention are achieved by the jewelry holder having the upper and lower plastic layers and the backing layer comprise a monolithic substantially planar member.

Still further objects of the invention are achieved by the jewelry holder having the backing layer is selected from the group consisting of fabric, cardboard, paper, foam and plastic sheet.

Still further objects of the invention are achieved by the jewelry holder the having the first pliable plastic cover sheet is a transparent vinyl sheet and the upper plastic layer is a vinyl sheet.

Still further objects of the invention are achieved by the jewelry holder having the first pliable plastic cover sheet, the second pliable plastic sheet and the backing layer being sufficiently flexible to be at least one of rolled or folded on itself without delaminating the first pliable plastic cover sheet, and the upper plastic layer.

Still further objects of the invention are achieved by method of using the jewelry holder comprising the steps of peeling away the cover layer form the upper plastic layer, inserting jewelry between the cover layer from the upper plastic layer, replacing the upper plastic layer to surround the jewelry inserted therein by a region of detachable lamination of the first pliable plastic cover sheet to the upper plastic layer.

The above and other objects, effects, features, and advantages of the present invention will become more apparent from the following description of the embodiments thereof taken in conjunction with the accompanying drawings.

BRIEF DESCRIPTION OF THE DRAWINGS

FIG. 1A is a cross-sectional elevation view of a first embodiment of a jewelry case, whereas FIG. 1B is a cross-sectional elevation view of the first embodiment showing a jewelry item held between pliable cover layer and an upper plastic layer supported by the backing layer. FIG. 1C is a cross-sectional elevation view of another embodiment of a jewelry case showing the partial peel of a corner of the pliable cover layer.

FIG. 5A is an open plan view of another alternative embodiment of the invention whereas FIGS. 5B and 5C are closed views of alternative embodiments.

FIG. 7A is a plan view of another alternative embodiment of the invention in the open position for inserting and removing jewelry whereas FIG. 7B is a plan view of the same embodiment closed for storage or transport of the jewelry stored therein.

FIG. 10A is a perspective front view of the embodiment of FIG. 9 being opened, whereas

FIG. 13A is a top plan view of the embodiment of FIG. 12D in closed position, whereas FIG. 13B is top plan view thereof with the upper most portion in partially open position FIG. 14A is a perspective view of the embodiment of FIG. 12D and FIG. 13A showing the upper most layer thereof holding jewelry, whereas

DETAILED DESCRIPTION

Figure 2:
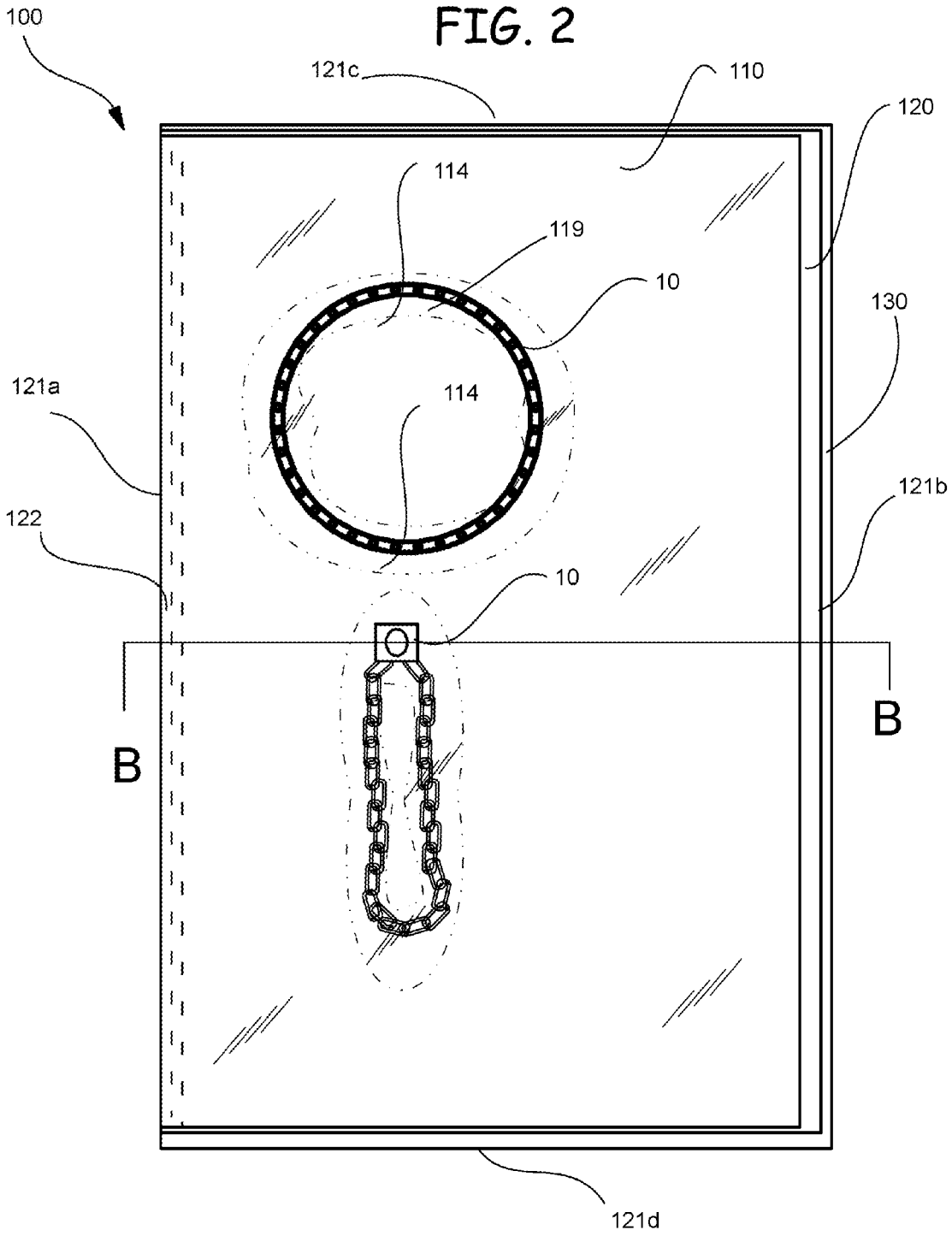
FIG. 2 is a plan view of FIG. 1B showing the position of section line B-B

Referring to FIGS. 1 through 14, wherein like reference numerals refer to like components in the various views, there is illustrated therein a new and improved Jewelry holder, generally denominated 100 herein.

In accordance with the present invention, FIG. 1 illustrates such a jewelry holder 100 having a cover layer 110 of a pliable plastic sheet or film, a backing layer 120 of a planar materials that is less pliable than the cover layer 110, the backing layer 120 also having an upper plastic layer 130 capable of clinging engagement with the cover layer 110.

The cover layer 110 is preferably clear plastic, and more preferably clear vinyl, and fabricated in a laminated structure with the upper plastic layer 130 connected or bonded to the backing layer 120, but the cover layer 110 capable of being peeled away from the upper plastic sheet 130. It is more preferable that both the cover 110 and upper plastic layer 130 are thin vinyl sheets that have an inherent level of adhesive attractive that causes one to deform and match the surface contour of the other to form a sealed region around jewelry 10. This desirable property can be due to static attraction and the inherent tackiness of soft pliable plastic films.

More preferably, the cover 110 is attached to the backing layer 120 on at least a portion of one side to fold open for access to jewelry. In FIG. 2, for example, cover 110 is attached to the backing sheet 120 at seam 122. The backing layer 120, in addition to the upper plastic layer or sheet 130, can include additional stiffening layers of fabric, plastic sheet, paper, foam or cardboard sheet and the like.

More preferably, as shown in FIG. 1C, the jewelry holder 100 has a backing layer 120 with upper plastic layer 130 and 130' on opposing sides 120*a* and 120*b*, as well as cover layer 110 and 110' each attached to at least part of an edge 121*a, b, c* or *d* so that plastic layers 130 and 130' can be temporarily peeled away to expose jewelry items 10, to access them for removal or replacement after they are initially inserted between the pliable cover layer 110 and the upper plastic layer 130. As shown in FIG. 1B and FIG. 2-4, the cover layer and upper plastic layer will self adhere at margins 114, forming an air pocket or cavity 119 around the jewelry 10. Hence, it is most preferable that the backing layer 120 have some flexibility, but less than the pliable cover sheet 130, to facilitate peeling away the cover sheet, but also conforming with the coversheet 130 to form a sealed pocket or cavity 119 around ease jewelry piece 10. Having a somewhat pliable backing layer 120 allows for the formation of cavity 119 around larger size jewelry 10. When the flexibility or pliability in backing sheet 120 is optionally provided by padding, the jewelry 10 is better protected during transport.

It should be appreciated that stitching 135 can used to attach the cover layer 110 to any of the edges of either the backing layer 120 and or the upper layer sheet 130, and form folding seams 122.

Figure 3:
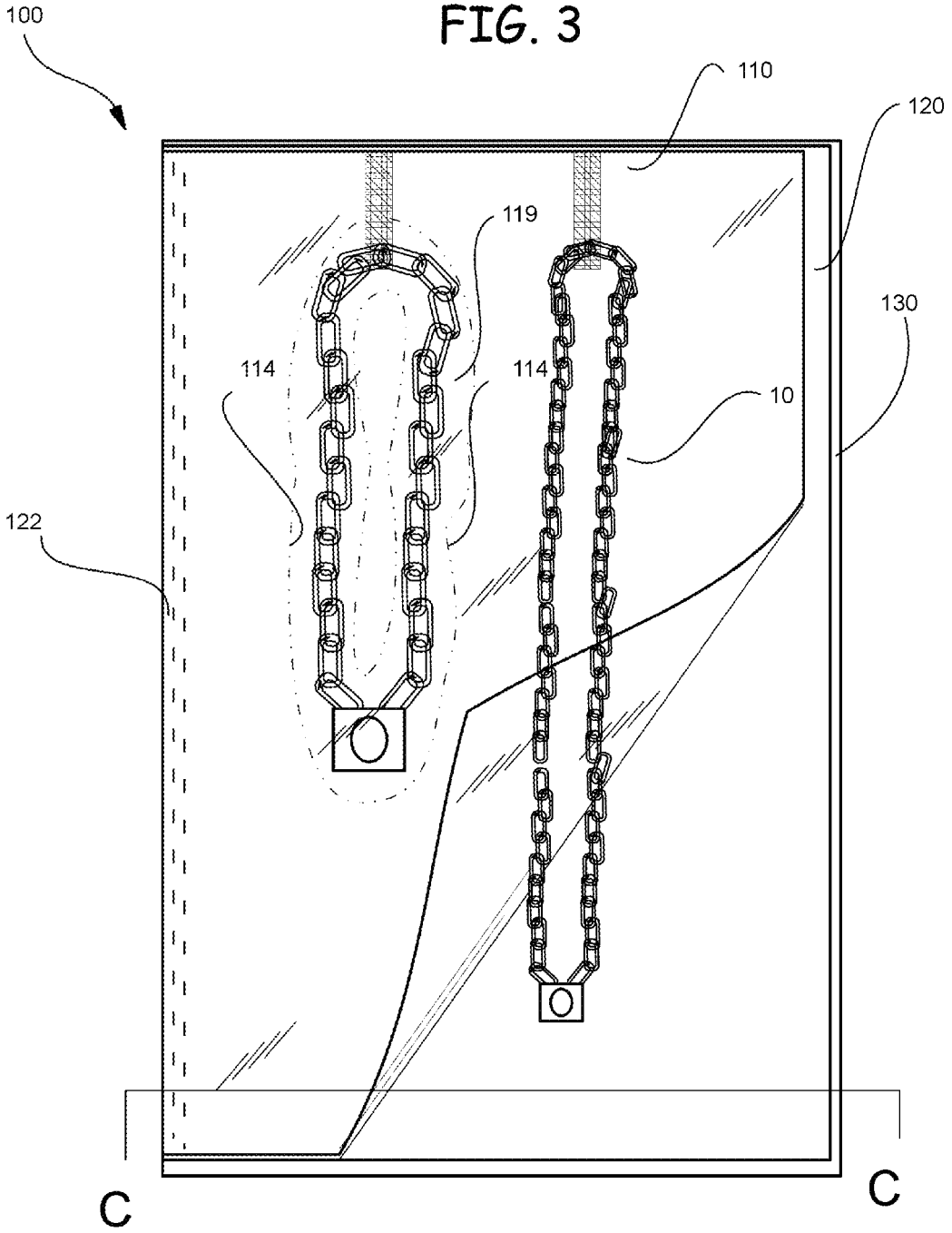
FIG. 3 is a plan view of an alternative embodiment of the invention, showing an approximate position of section line C-C in FIG. 1C.

In another embodiment of the jewelry holder 100 in FIG. 3, straps or fabric loops 115 are attached to the backing layer 120 either directly or via the layer 130 to extend inward from an edge. These straps or loops 115 allow a necklace 10 to be held at the top of the chain to be spread out and untangled before the upper or cover layer 110 is laid down against the upper layer 130. The fabric loops 115 can be tied together, but preferably deploy mating hook and loop (Velcro™) fasteners.

Figure 4:
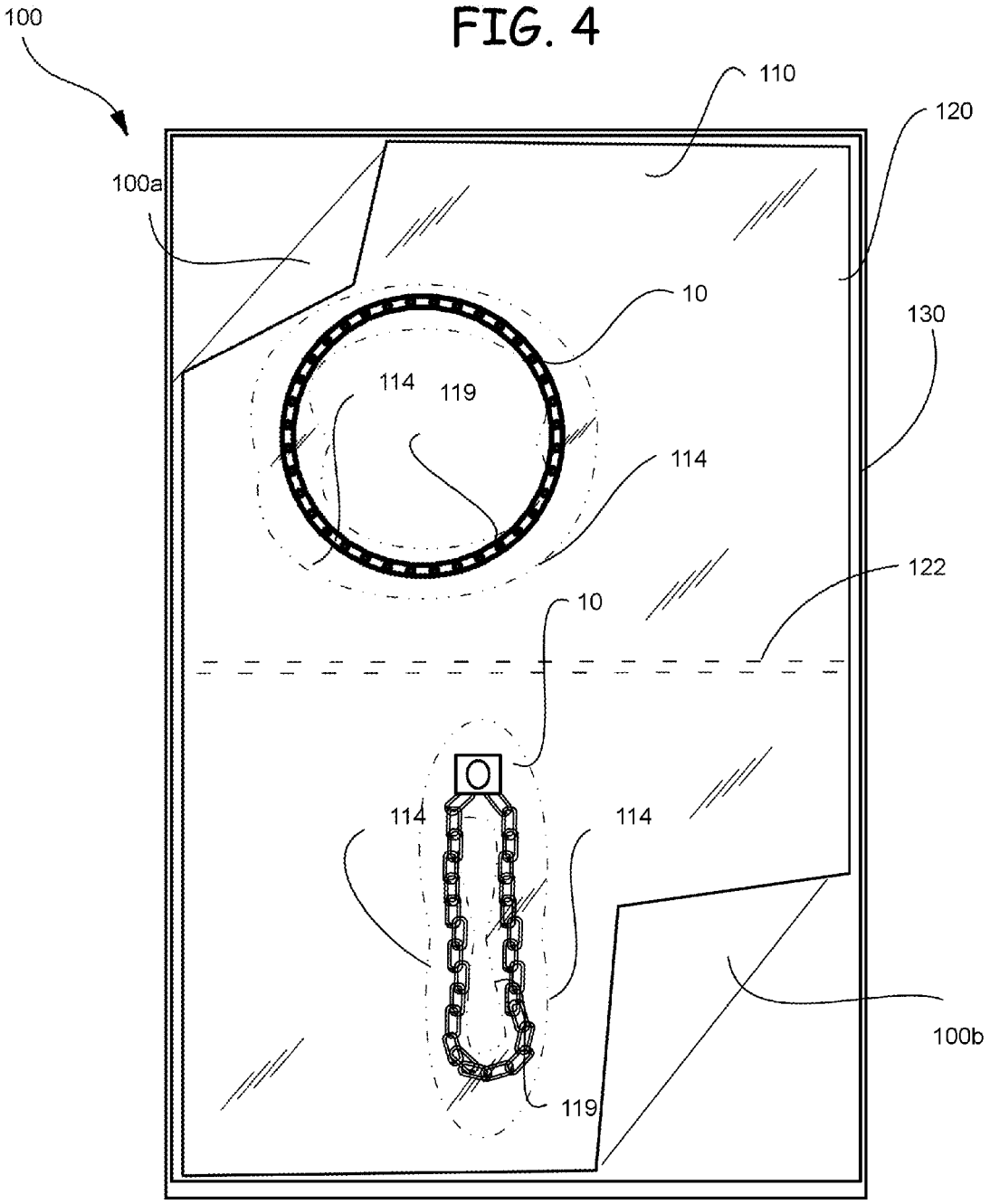
FIG. 4 is a plan view of another alternative embodiment of the invention.

FIG. 4 illustrates another embodiment of the invention in which a single backing layer 120 has 2 cover sheets 110 is divided into 2 parts 110*a* and 110*b* that open in opposite directions folding away from a common seam 122.

FIG. 5 A-C illustrate embodiments of the jewelry holder 110 in which the straps or fabric loops 115 are attached to the backing layer 120 at folding seam 122, which is now expands horizontally. FIG. 5A is an open view, whereas FIGS. 5B and 5C are closed views of alternative embodiments.

Figure 6A:
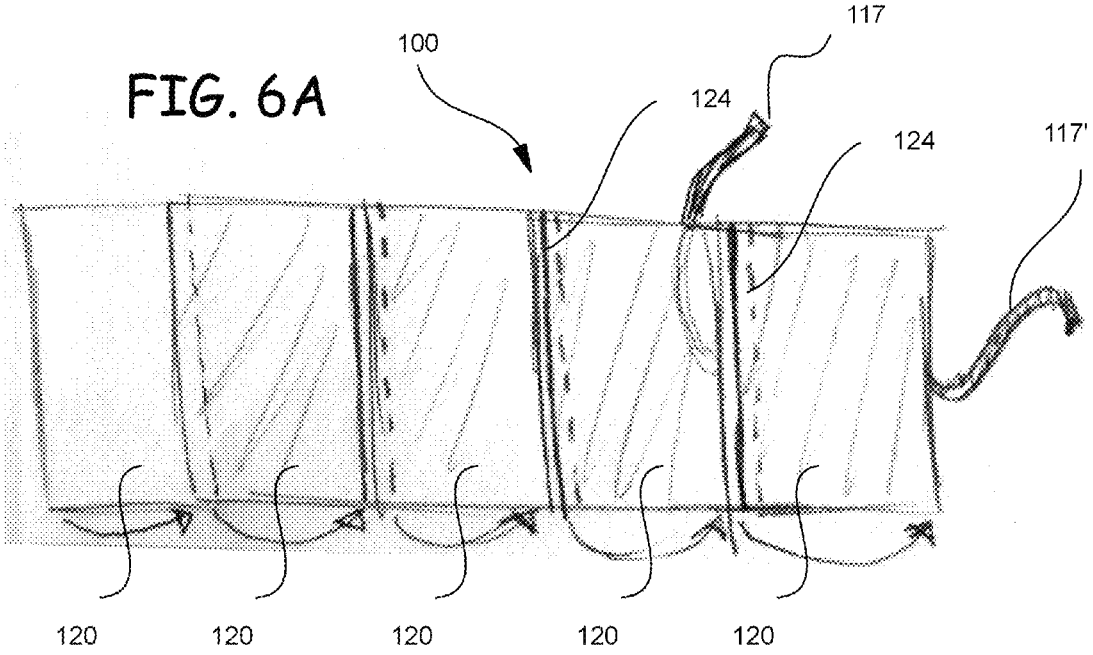
FIG. 6A-B are plan views of an additional alternative embodiment of the invention in which the holder is open in FIG. 6A and closed in FIG. 6B.
Figure 6B:
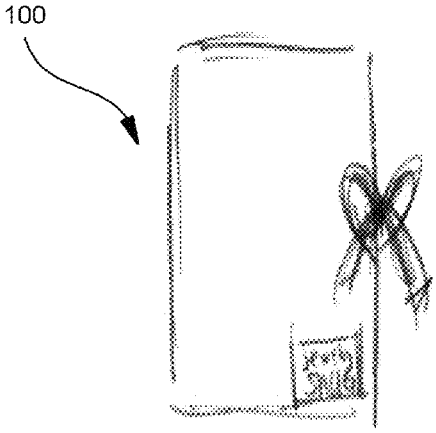

FIG. 6A-C are plan views of additional alternative embodiments of the invention. In FIG. 6A one side of the jewelry holder 100 has 2 cover portions 110 and 110', juxtaposed one above the other, in which each folds away from the backing layer 120 at their respective connecting edge seams 122 and 122'. The opposite side of the device, FIG. 6B, also has a cover layer or sheet 110".

In FIG. 6A, the lower portion associated with cover 110' optionally has a vertical ribbon 131 attached to the upper plastic layer 130 for the placement of rings and earrings adjacent to each other. The cover sheet 110 optionally has corners that are cut diagonally to expose the underlying backing sheet 120 for easier grasping of the diagonal edge of the cover layer 110 for peeling it away from the upper plastic layer 130.

Figures 7A, 7B:
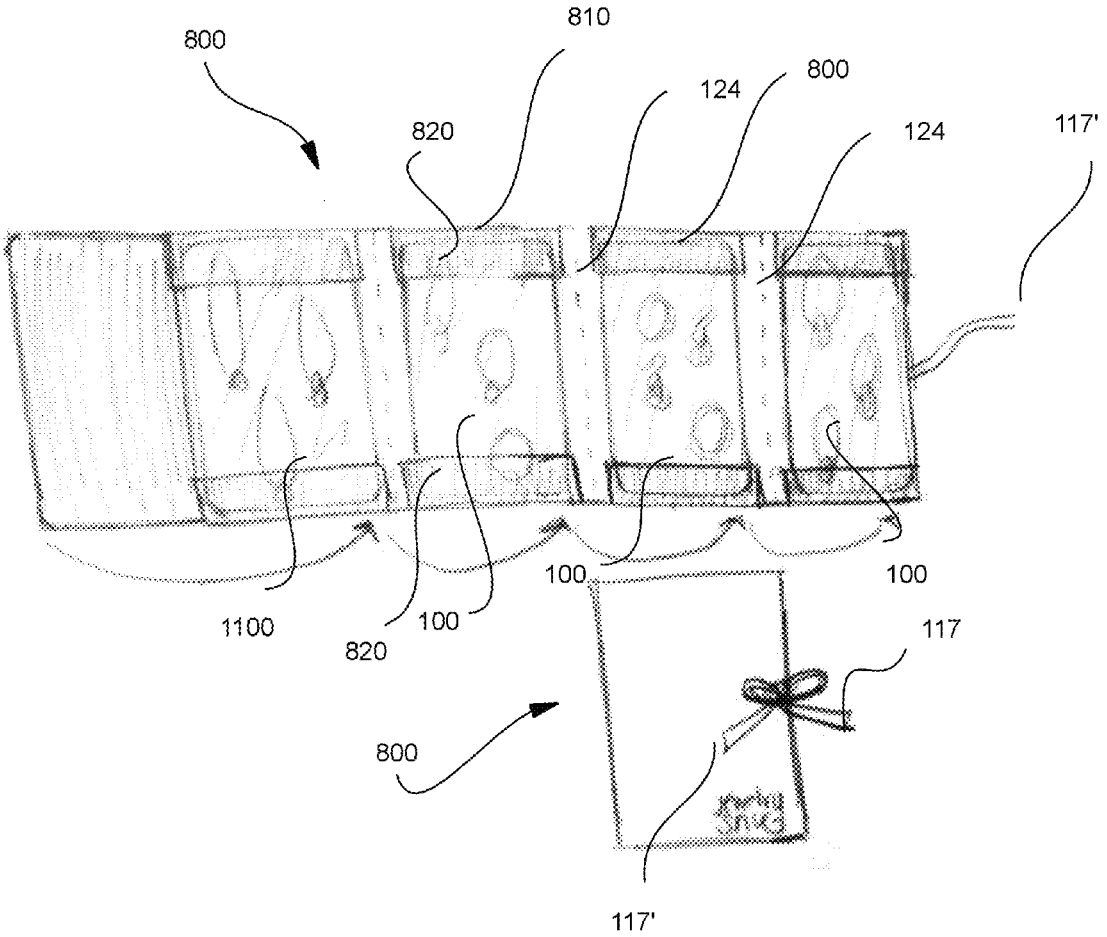
Figure 8:
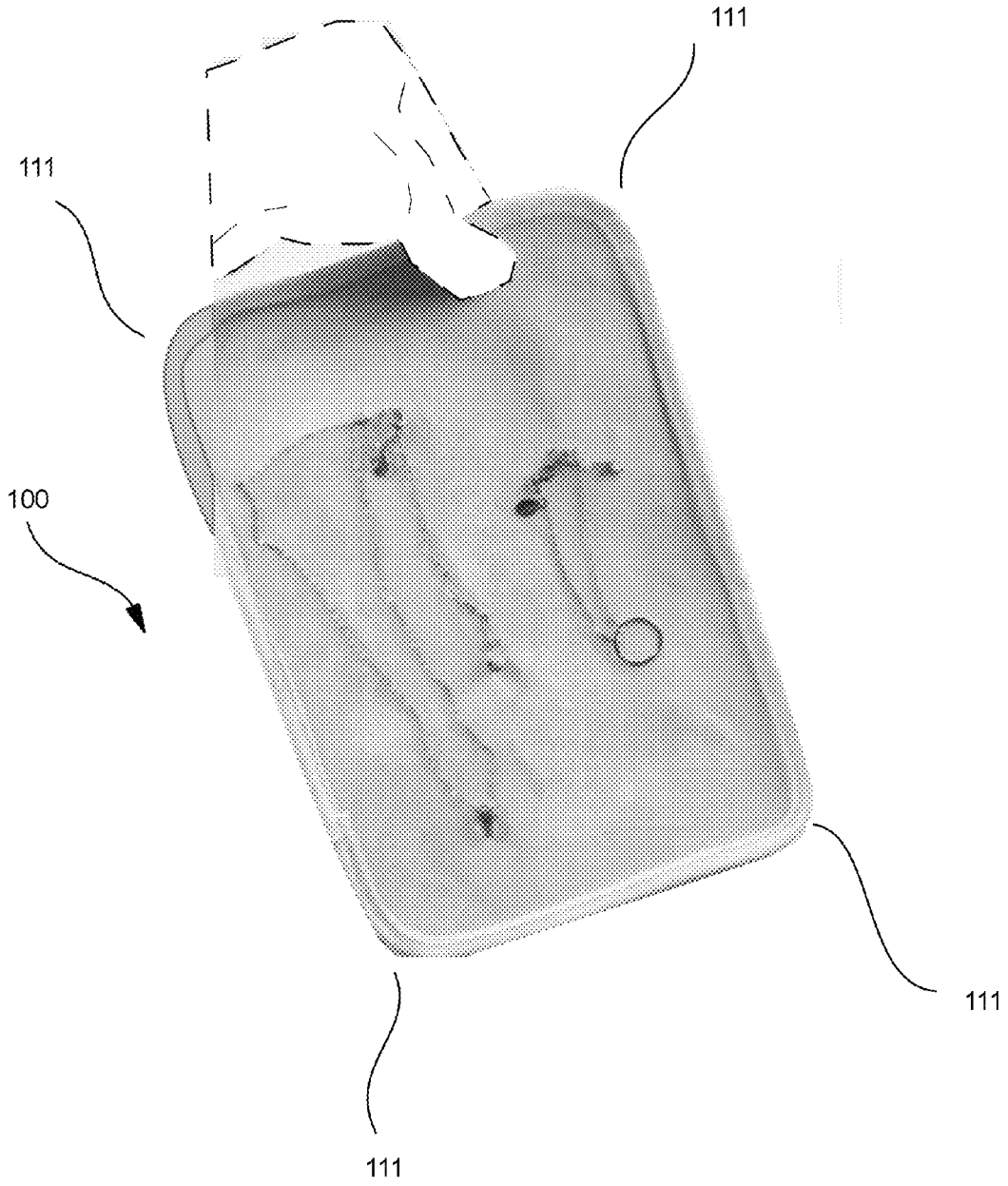
FIG. 8 is a plan view of another alternative embodiment of the invention.

FIG. 7A is a plan view of another alternative embodiment of the invention in the open position for inserting and removing jewelry whereas FIG. 7B is a plan view of the same embodiment closed for storage or transport of the jewelry stored therein. Case or holder 100, has multiple backing sheets 120, each connect to the adjacent backing sheet by a folding seam 124. The device is closed as shown in FIG. 7B, in which ribbons 117 and 117' on opposite sides are connected, such as by a knot or via loop and hook fasteners.

FIG. 8A is a plan view of another alternative embodiment of the invention in the open position for inserting and removing jewelry whereas FIG. 8B is a plan view of the same embodiment closed for storage or transport of the jewelry stored therein. The case 800 has multiple holders 810 connected folding seams 124. Each holder 810 has a top and bottom envelop or slot 820 for receiving a single planar case 100 such as shown in FIG. 2. The case 800 folds to a compact shape (FIG. 8B) as does the case 100 in FIGS. 7A and &B, being secured by ribbons 117' and 117.

Figure 9:
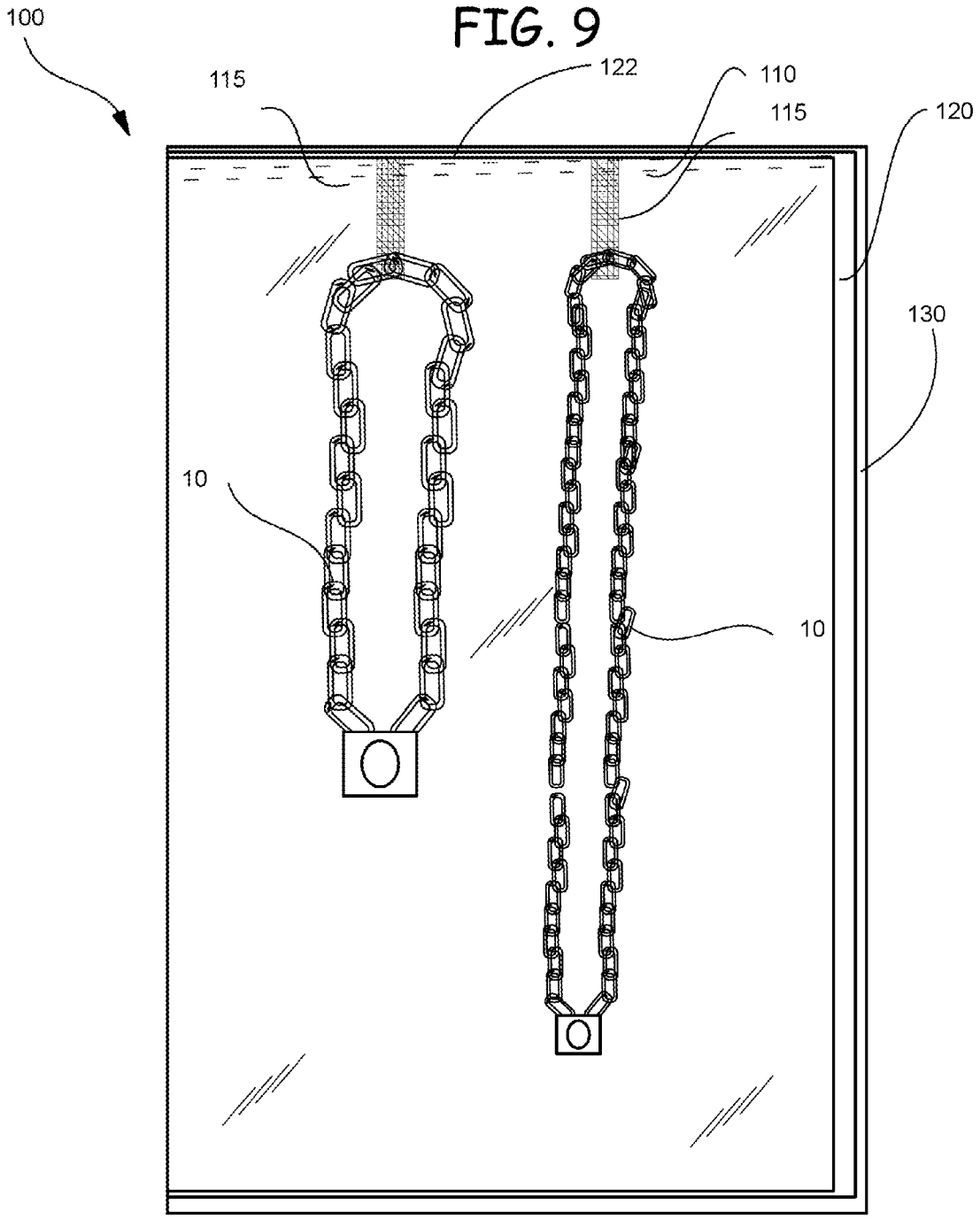
FIG. 9 is a perspective front view of another alternative embodiment of the invention in a closed position holding jewelry therein.

FIG. 9 is a perspective front view of another alternative embodiment of the invention in a closed position holding jewelry therein. The cover sheet 110 in this embodiment is shown with rounded corners 111, which are stitched into a flexible covering bezel 116. The backing layer 120 has rounded corners 111 of a matching shape.

Figure 10B:
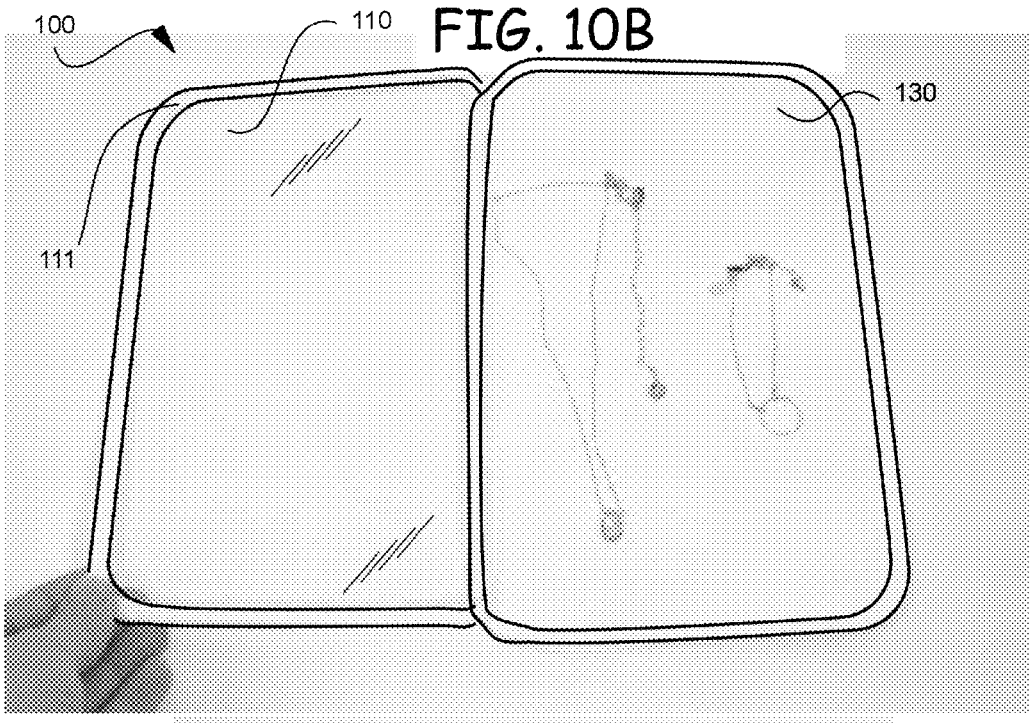
FIG. 10B is a perspective view of the jewelry case completely opened.
Figure 10A:
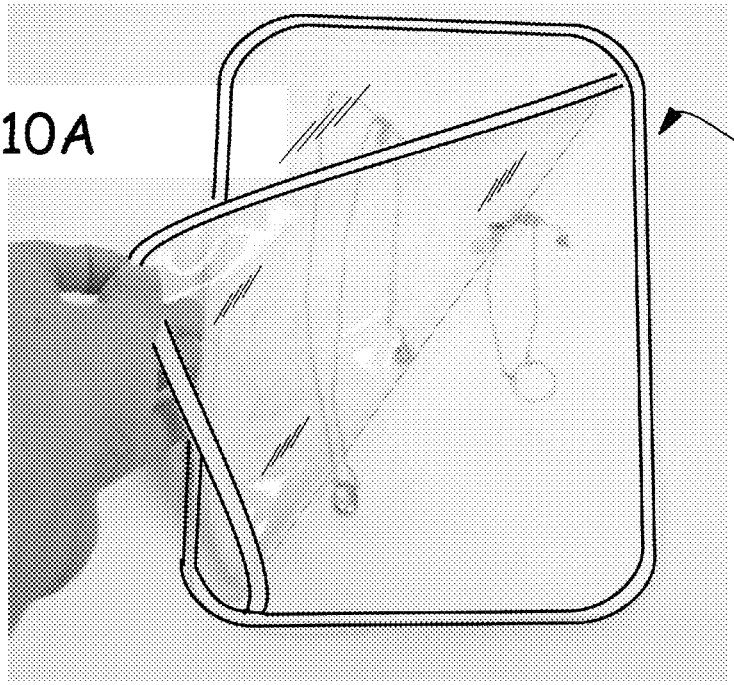

FIG. 10A is a perspective front view of the embodiment of FIG. 9 being opened, whereas FIG. 10B is a perspective view of the jewelry case 100 completely opened.

Figures 11A, 11B, 11C, 11D, 11E:
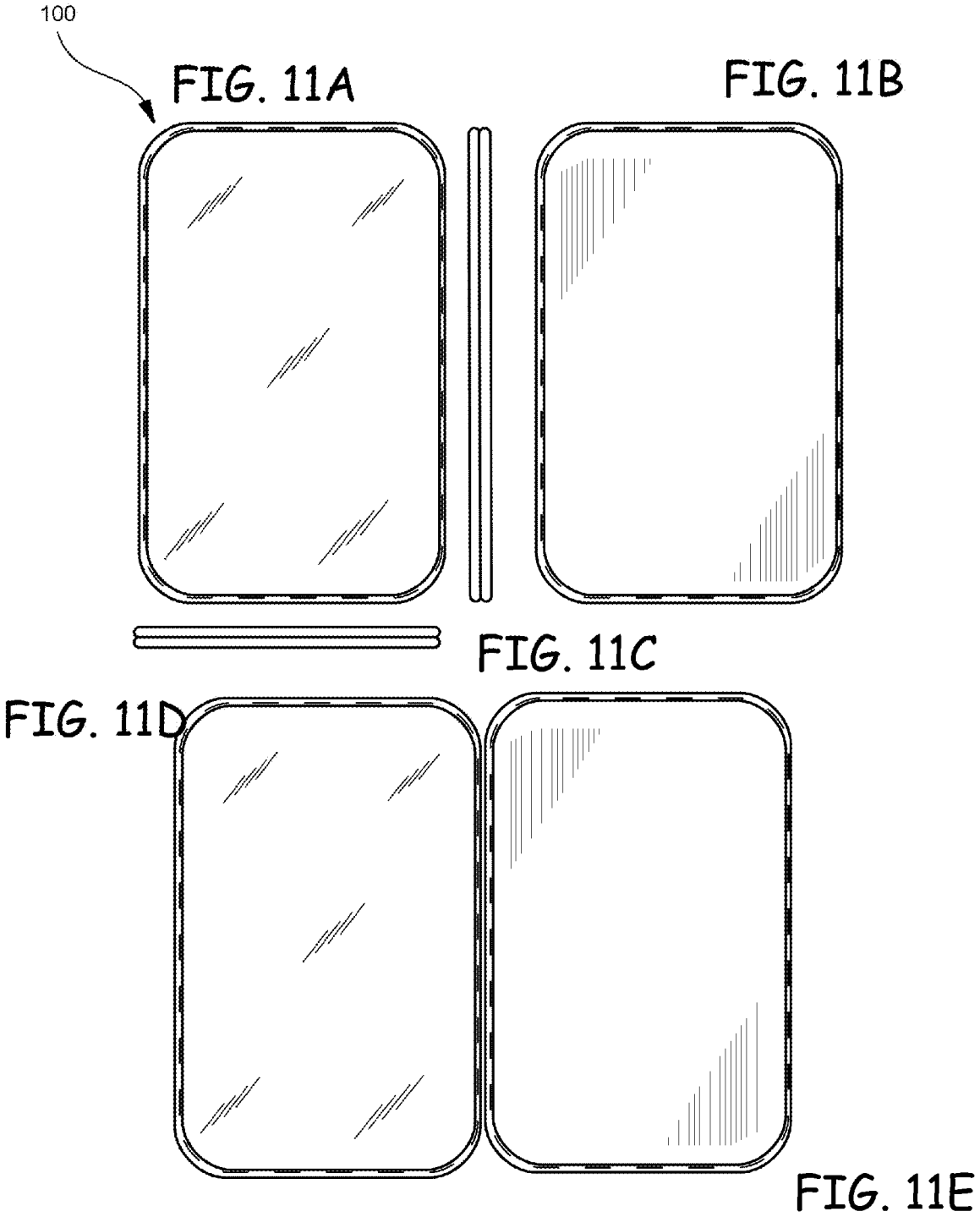
FIG. 11A is a plan view of the front of the embodiment of the jewelry case in FIGS. 9 and 10A-10B.
FIG. 11B is a back plan view thereof.
FIG. 11C is a bottom and top elevation view thereof.
FIG. 11D is a right and left side elevation view thereof and FIG. 11E is a top plan view thereof when the case is opened.

FIG. 11A is a plan view of the front of the embodiment of the jewelry case in FIGS. 9 and 10A-10B; FIG. 11B is a back plan view thereof; FIG. 11C is a bottom and top elevation view thereof; FIG. 11D is a right and left side elevation view thereof and FIG. 11E is a top plan view thereof when the case is opened.

Figure 12A:
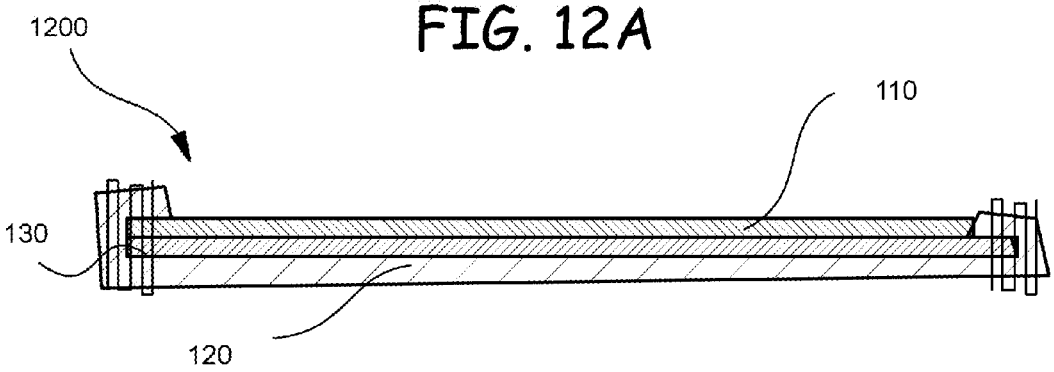
FIG. 12A-12D are cross-sectional elevations of alternative embodiments
Figure 12B:
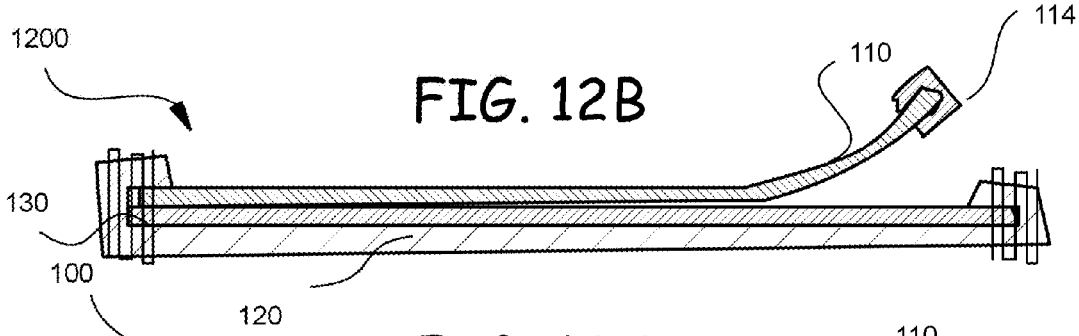
Figure 12C:
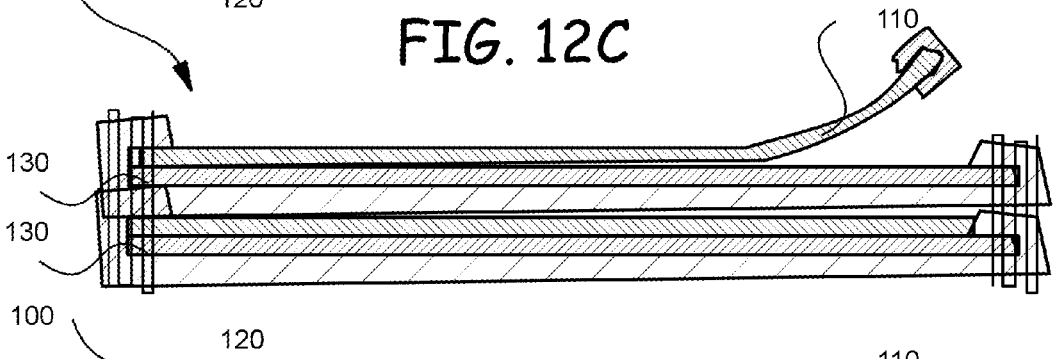
Figure 12D:
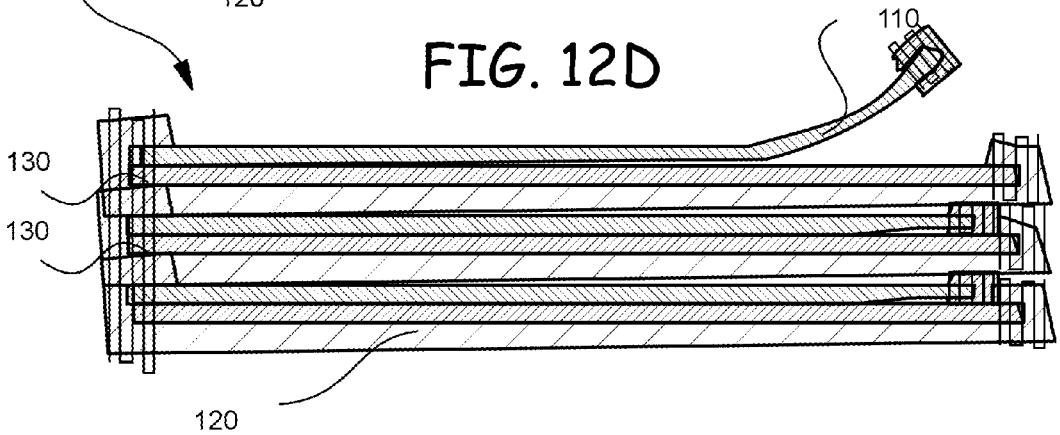
Figure 14A:
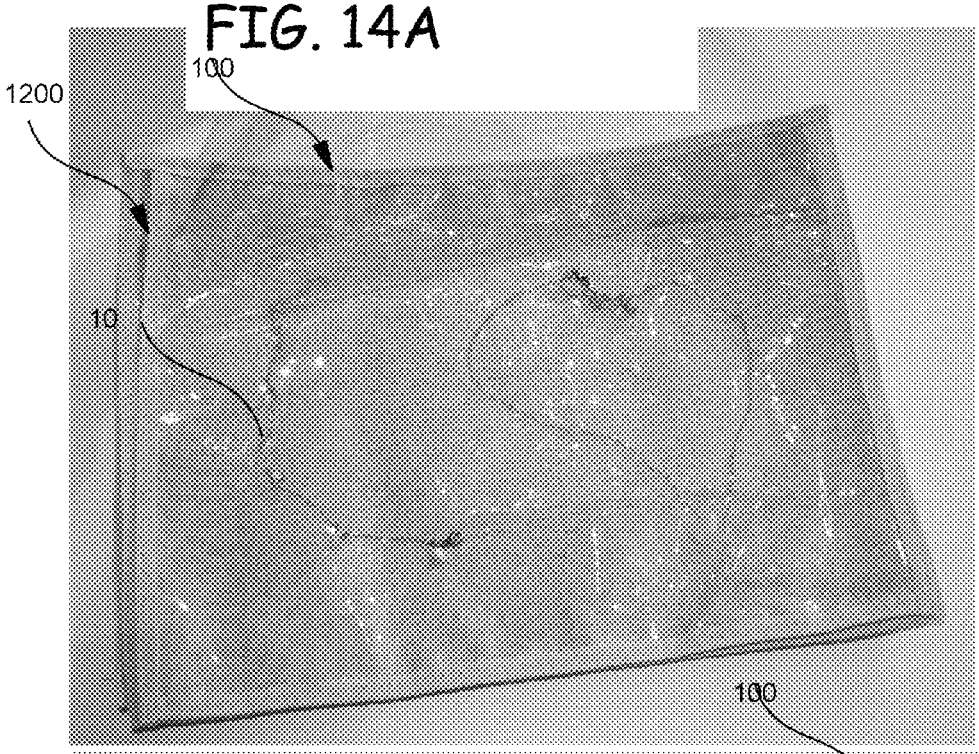
Figure 14B:
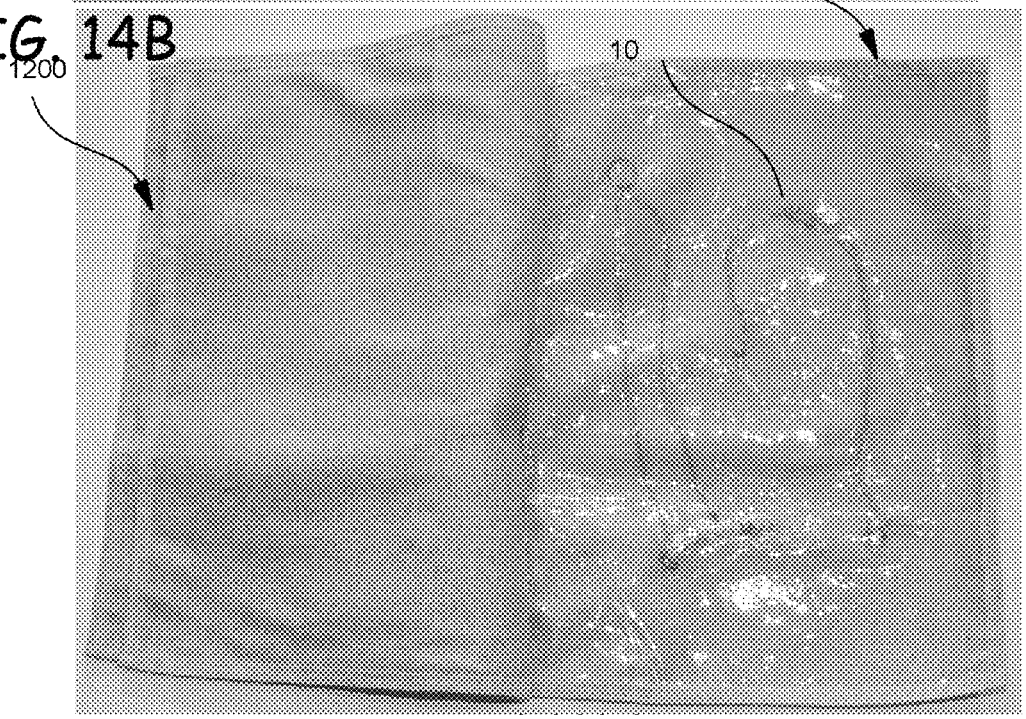
FIG. 14B is a perspective view thereof opened to reveal jewelry stored in the second storage layer below the upper most layer.

FIG. 12-14 illustrate an alternative embodiment of the invention in which the jewelry holder 100 is formed of pages 1200 shown in FIG. 12A, each page having a cover layer 110 of a pliable plastic sheet or film, a backing layer 120 of a planar materials that is generally less pliable than the cover layer 110, the backing layer 120 also having an upper plastic layer 130 capable of clinging engagement with the cover layer 110. Each page 1200 has a fabric backing layer 120, and optionally as shown in FIG. 12B-D, fabric edge or bezel 114 that is folded around and stitched to the perimeter of the both the top and bottom of cover layer 110. In FIGS. 12B and 13B, the cover layer 110 is illustrated as partially peeled away from the upper plastic layer 130. The pages 1200 are stitched together at the top so each page 1200 can be folded away from the others to view, store or retrieve jewelry, as shown in FIGS. 14A and 14B. The embodiment of the jewelry case 100 in FIG. 12C has 2 pages, while the embodiment 100 in FIG. 12D has 3 pages.

In the preferred embodiment of the invention the first pliable plastic cover sheet, the second pliable plastic sheet and the backing layer are sufficiently flexible to be at least one of rolled or folded on itself without delaminating the first pliable plastic cover sheet, and the upper plastic layer. The desired amount of static or adhesive cling between a clear vinyl cover sheet and the second pliable plastic sheet is achieved, without causing delaminating upon the rolling or folding of the jewelry holder when the vinyl has a thickness of about 4 to 10 mils (0.1 mm to 0.25 mm), but more preferably between about 7 mils (0.18 mm). As such a thin clear vinyl cover sheet can be difficult to grasp, it has been discovered that providing the fabric edge or bezel 114 that is folded around and stitched to the perimeter of the both the top and bottom of cover layer 110 with a width of about 1 to 5 mm allows such grasping without otherwise deteriorating the static clinginess and detachable adhesion that is desirable to store the jewelry securely, and thus prevent damage or twisting of fine wires, when the holder is rolled or folded as described in the various embodiments above.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

I claim:

1. A jewelry holder, comprising:

a) at least a first pliable plastic cover sheet, b) a backing layer having a top and bottom opposing sides, c) an upper plastic layer attached to the top side of the backing layer and directly opposing the first pliable plastic cover sheet for the detachable clinging engagement therewith, wherein the backing layer with the attached upper plastic layer is less pliable than the plastic cover sheet, d) wherein the first pliable plastic cover sheet, backing layer and upper plastic layer are detachably laminated together with the cover layer having two or more edges capable of peeling away from the upper plastic layer for inserting and removing materials to be held there between.

2. The jewelry holder of claim 1, further comprising;

a) a lower plastic layer attached to the bottom side of the backing layer, b) a second pliable plastic sheet attached to at least one of the backing layer and the lower plastic layer and directly opposing the lower plastic layer for the detachable clinging engagement therewith, and having two or more edges capable of folding away from the lower plastic layer for the insertion and removable of materials to be held there between.

3. The jewelry holder of claim 2, wherein the upper and lower plastic layers and the backing layer comprise a monolithic substantially planar member.

4. The jewelry holder of claim 1, wherein the backing layer is selected from the group consisting of fabric, cardboard, paper, foam and plastic sheet.

5. The jewelry holder of claim 1, wherein the first pliable plastic cover sheet is a transparent vinyl sheet and the upper plastic layer is a vinyl sheet.

6. The jewelry holder of claim 1 wherein the first pliable plastic cover sheet, the second pliable plastic sheet and the backing layer are sufficiently flexible to be at least one of rolled or folded on itself without delaminating the first pliable plastic cover sheet, and the upper plastic layer.

7. A jewelry holder, comprising:

a) at least a first pliable plastic cover sheet, b) a backing layer fabric having a top and bottom opposing sides, c) an upper plastic layer attached to the top side of the backing layer and directly opposing the first pliable plastic cover sheet for the detachable clinging engagement therewith, d) wherein the first pliable plastic cover sheet, backing layer and upper plastic layer are detachably laminated together with the cover layer having two or more edges capable of being peeled away from the upper plastic layer for inserting and removing materials to be held there between.

8. The jewelry holder of claim 7, wherein the upper plastic layer, first pliable plastic cover sheet and the backing layer comprise a monolithic substantially planar member.

9. The jewelry holder of claim 7, wherein the backing layer is linen fabric.

10. The jewelry holder of claim 7, wherein the first pliable plastic cover sheet is a transparent vinyl sheet and the upper plastic layer is a vinyl sheet.

11. The jewelry holder of claim 7 wherein the first pliable plastic cover sheet, the second pliable plastic sheet and the backing layer are sufficiently flexible to be at least one of rolled or folded on itself without delaminating the first pliable plastic cover sheet, and the upper plastic layer.

12. A method of protecting jewelry in storage or transport, the method comprising the steps:

a) providing one or more pieces of jewelry b) providing a jewelry holder comprising;

i) at least a first pliable plastic cover sheet, ii) a backing layer having a top and bottom opposing sides, iii) an upper plastic layer attached to the top side of the backing layer and directly opposing the first pliable plastic cover sheet for the detachable clinging engagement therewith, iv) wherein the first pliable plastic cover sheet, backing layer and upper plastic layer are detachably laminated together with the cover layer having two or more edges capable of being peeled away from the upper plastic layer for inserting and removing materials to be held there between, c) peeling away the cover layer form the upper plastic layer, d) inserting jewelry between the cover layer from the upper plastic layer, e) replacing the upper plastic layer to surround the jewelry inserted therein by a region of detachable lamination of the first pliable plastic cover sheet to the upper plastic layer.

13. The method of protecting jewelry in storage or transport according to claim 12 wherein the upper and lower plastic layers and the backing layer comprise a monolithic substantially planar member.

14. The method of protecting jewelry in storage or transport according to claim 12 wherein the backing layer is selected from the group consisting of fabric, cardboard, paper, foam and plastic sheet.

15. The method of protecting jewelry in storage or transport according to claim 12 wherein the first pliable plastic cover sheet is a transparent vinyl sheet and the upper plastic layer is a vinyl sheet.

16. The method of protecting jewelry in storage or transport according to claim 14 wherein the backing layer is linen fabric.

17. The method of protecting jewelry in storage or transport according to claim 16 wherein the first pliable plastic cover sheet has a fabric bezel surrounding the perimeter thereof.

18. The method of protecting jewelry in storage or transport according to claim 15 wherein the transparent vinyl cover sheet has a thickness of at least about 4 mils.

19. The method of protecting jewelry in storage or transport according to claim 12 wherein the jewelry holder multiple stacked pages attached at a common side, each page comprising;

a) at least a first pliable plastic cover sheet, b) a backing layer having a top and bottom opposing sides, c) an upper plastic layer attached to the top side of the backing layer and directly opposing the first pliable plastic cover sheet for the detachable clinging engagement therewith.

20. The method of protecting jewelry in storage or transport according to claim 19 wherein the first pliable plastic cover sheet is a transparent vinyl sheet having a thickness less than 10 mils and the upper plastic layer is a vinyl sheet.

21. The jewelry holder of claim 7, wherein the first pliable plastic cover sheet has a fabric bezel surrounding the perimeter thereof.

22. The jewelry holder of claim 10 wherein the transparent vinyl cover sheet has a thickness of at least about 4 mils.

23. The jewelry holder of claim 7 wherein the first pliable plastic cover sheet is a transparent vinyl sheet having a thickness less than 10 mils and the upper plastic layer is a vinyl sheet.

24. The jewelry holder of claim 22, wherein the first pliable plastic cover sheet has a fabric bezel surrounding the perimeter thereof.

25. The jewelry holder of claim 1, wherein the first pliable plastic cover sheet has a fabric bezel surrounding a perimeter thereof.

26. The jewelry holder of claim 25 wherein the fabric bezel is folded around and stitched to the perimeter of the first pliable plastic cover sheet and has a width of about 1 to 5 mm.

* * * * *